US008177588B1

(12) United States Patent
Peraza

(10) Patent No.: US 8,177,588 B1
(45) Date of Patent: May 15, 2012

(54) BATTERY TERMINAL

(75) Inventor: Jose Peraza, Miami, FL (US)

(73) Assignee: Uniflex Battery Terminal, Inc., Homestead, FL (US)

( * ) Notice: Subject to any disclaimer, the term of this patent is extended or adjusted under 35 U.S.C. 154(b) by 0 days.

(21) Appl. No.: 12/955,537

(22) Filed: Nov. 29, 2010

(51) Int. Cl.
*H01R 4/40* (2006.01)

(52) U.S. Cl. ..... 439/769; 439/773

(58) Field of Classification Search ..... 439/754, 439/765–773
See application file for complete search history.

(56) References Cited

U.S. PATENT DOCUMENTS

| | | | | |
|---|---|---|---|---|
| 2,152,832 | A * | 4/1939 | Winchester | 439/769 |
| 5,556,309 | A * | 9/1996 | Sharpe et al. | 439/759 |
| 6,174,207 | B1 * | 1/2001 | Cleveland | 439/773 |
| 6,971,925 | B1 * | 12/2005 | Orange | 439/773 |
| 7,303,448 | B1 * | 12/2007 | Sproesser | 439/773 |

* cited by examiner

*Primary Examiner* — Khiem Nguyen
(74) *Attorney, Agent, or Firm* — Sanchelima & Associates, P.A.

(57) ABSTRACT

A battery contact terminal assembly for electrically connecting the conducting end of a cable to a battery post so that the mechanical and electrical connection can be effectively ensured. The assembly includes two hingedly mounted members with semicircle ends each that embrace the post when a fastening member tightens the free ends. The fastening members include a hook that pulls the conducting end against one of the members. An anti-corrosion member is sandwiched between the two free ends for protection against the electrolyte chemical reaction typical in batteries.

4 Claims, 2 Drawing Sheets

BATTERY TERMINAL

BACKGROUND OF THE INVENTION

1. Field of the Invention

The present invention relates to a battery terminal assembly, and more particularly to the type that includes two contact members hingedly mounted to each other, and more particularly to such terminals with anti-sulfate protection.

2. Description of the Related Art

The posts in lead acid batteries are typically connected to a cable through a battery terminal. These battery terminals are made out of a malleable conducting material and the electrical connection is achieved by mechanically securing the terminal to the post member. The electrolytes in the batteries, however, degrade the conductivity of the terminal post interface, typically through sulfate deposits. Many times the fastening members used are covered with sulfates, making it difficult to release the terminals for maintenance or other purposes. Lubricants are typically applied through a washer, but only certain non-critical areas are reached. With the present invention, the lubricant reaches more critical parts of the terminal. Finally the pressure exerted by these conventional terminals is concentrated next to the loose ends of the terminals where the fastening members urge these loose ends towards each other. The torque exerted with the two hingedly connected terminal members is more efficiently transmitted and translated into a more effective electrical contact. The user of a conventional deformable lead terminal has to also overcome the shear resistance of the material.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a battery contact terminal assembly that has such a structure that permits to fasten itself to a battery post (negative or positive) while an electric cable is fastened within the battery contact terminal assembly, thereby achieving electric and mechanical contact simultaneously.

It is another object of this invention to provide a device that has a compartment built therein for receiving electric cables of different diameter.

It is still another object of the present invention to provide a battery contact terminal assembly comprising two hingedly interconnected members that is readily easily mounted and removed to and from the battery negative and positive posts.

It is still another object of the present invention to provide a device that includes an anti-sulfate member that also enhances the lubrication of the terminal assembly compartments protecting them from sulfation and corrosion.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
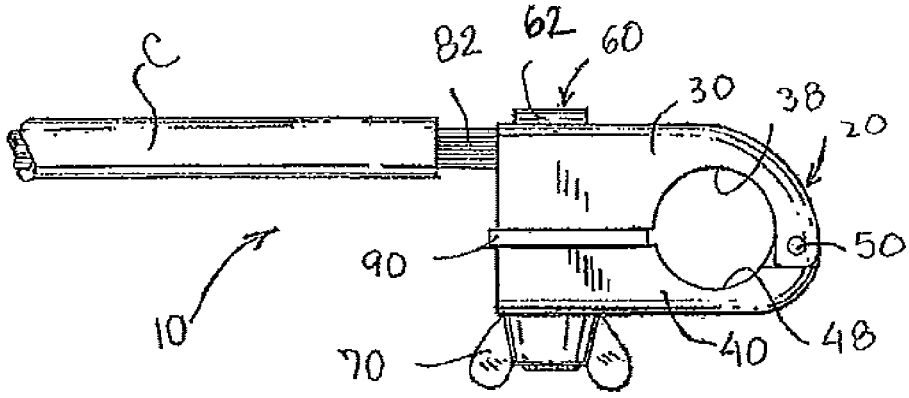
FIG. 1 represents a top view of a embodiment for this invention.

Referring now to the drawings, where the present invention is generally referred to with numeral 10, it can be observed that it basically includes contact terminal members 30 and 40, bolt member 60, wing nut 70, and pad 90.

As illustrated in FIGS. 1 through 5, battery contact terminal assembly 20 includes two contact terminal members 30 and 40 hingedly mounted to each other by pivot pin assembly 50. Contact terminal members 30 and 40 have semi-circular inner concave contact surfaces 38 and 48, respectively, which with the former area adjacent to each other substantially complementing each other to form a circle and cooperatively embrace a battery post P with the consequent electrical connection.

Figure 2:
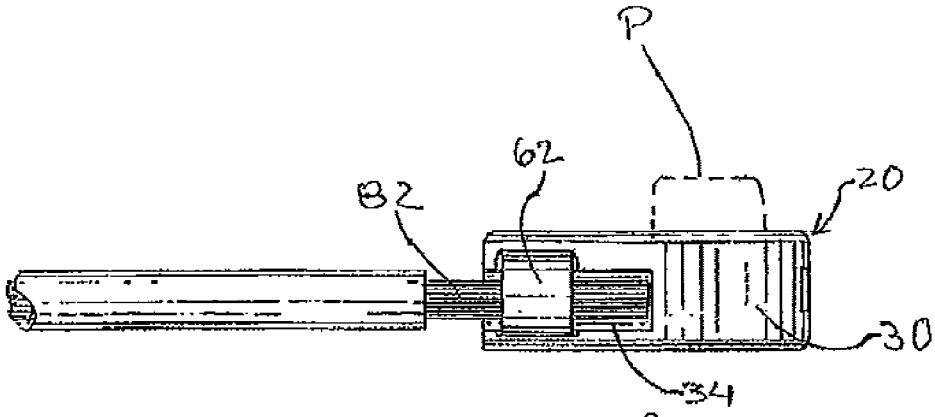
FIG. 2 shows an elevational side view of the present invention with a partial view of a contact electric cable mounted thereto.
Figure 3:
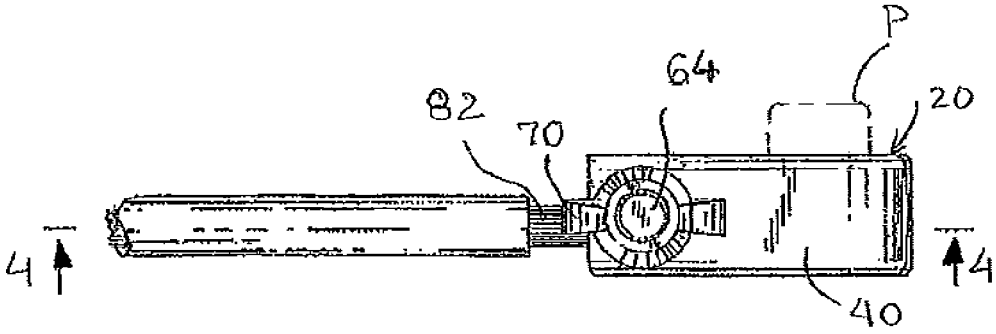
FIG. 3 illustrates is a view of the opposite side of the one shown in FIG. 2.
Figure 4:
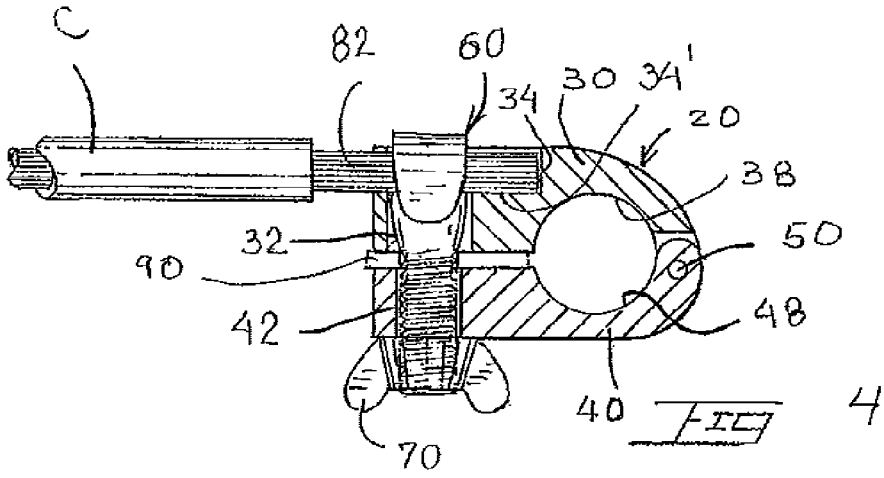
FIG. 4 is a representation of a cross section view of the battery contact terminal taken along line 4-4 in FIG. 3, showing an electric cable fastened by a bolt.
Figure 5:
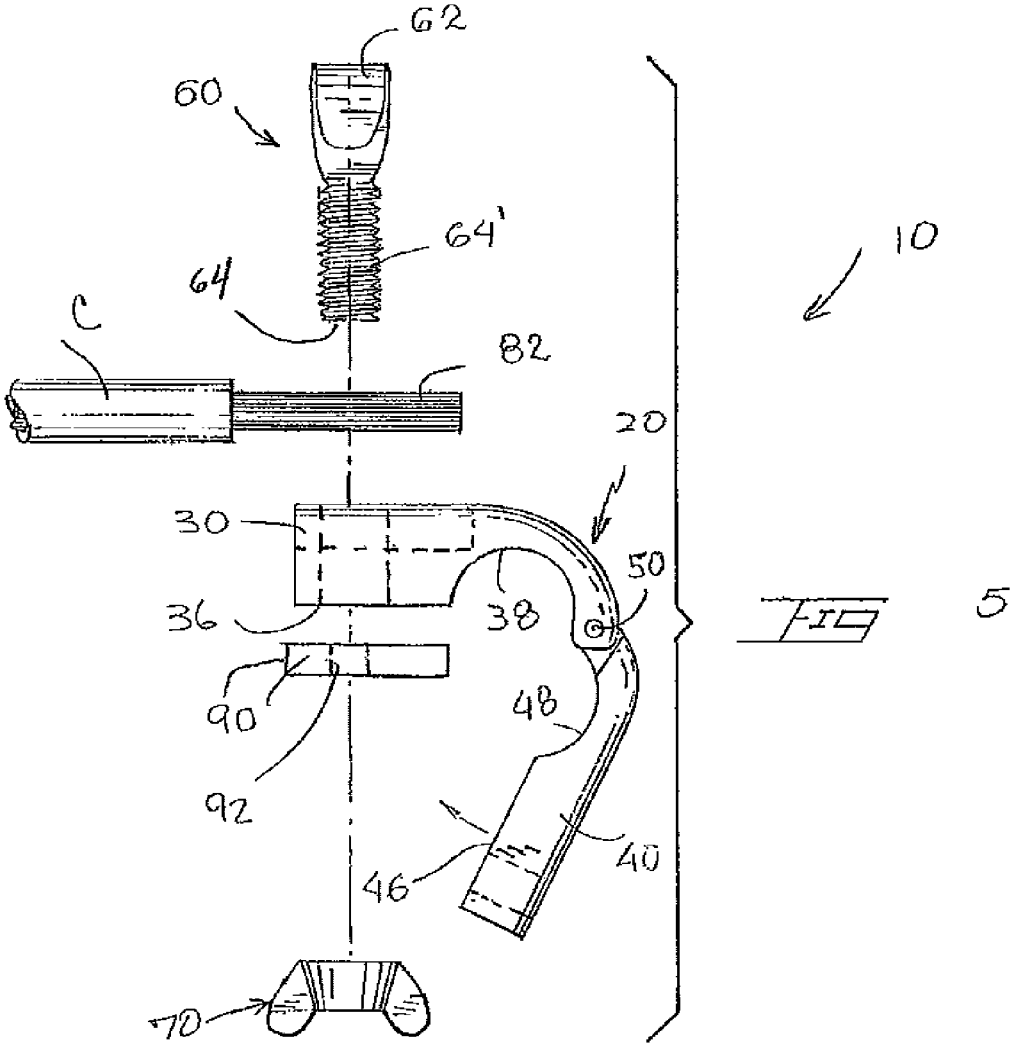
FIG. 5 is an exploded view of the components comprising one of the embodiments for the present invention.

Contact terminal member 30, in one of the embodiments, has compartment 34 for receiving end 82 of electric cable C, as seen in FIGS. 2 and 4.

Bolt member 60 comprises hook portion 62 and threaded portion 64', as best seen in FIGS. 1; 2; 4; and 5. Bolt member 60 embraces end 82 of electric cable C urging end 82 towards compartment 34. Electrical connection is achieved between end 82 and contact terminal assembly 20, with hook portion 62 pulling end 82, thereby bringing the latter against surface 34' of compartment 34. Contact terminal members 30; 40 and cable end 82 are thus electrically connected. Bolt member 60 passes through through openings 32 and 42 transversally across members 30 and 40, respectively. Bolt member 60 includes shank 64 with threaded portion 64'. Threaded portion 64' of bolt member 60 fits in opening 42 leaving out the end for wing nut 70 to be matingly secured to threaded portion 64'. In this manner, cable end 82 and battery contact terminal assembly 20 are sufficiently tightened to battery posts P to achieve an effective electrical connection.

Pad member 90, in one of the embodiments, is a spongy or porous material with through opening 92 located preferably the in middle of pad member 90 for bolt member 60 to pass through. Pad member 90 is sandwiched between surfaces 36 and 46 of members 30 and 40, respectively. Pad member 90 is impregnated with an anti-sulfate lubricating compound to avoid the accumulation in critical areas of sulfate compounds as a result of the chemical reaction commonly found in batteries. The production of these sulfates is a common undesirable by-product of the electrochemical reaction that takes place in most batteries. These sulfates tend to increase the resistance of the battery assembly contributing to increasing inefficiencies. Pad member 90 combats this problem.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A battery contact terminal assembly for electrically connecting the conducting end of a cable to a battery post, comprising:

A) a first contact terminal member having first and second ends, said first end including a compartment for receiving said conducting end and a first transversal through opening adjacent to said first end, and said second end having a semicircular shape with a cooperative radius to embrace one half of a battery post;

B) a second contact terminal member having third and fourth ends, said third end including a second transversal through opening coaxially aligned with said first through opening and said fourth end having a semicircular shape similar to said second end and being hingedly mounted to each other, so that said first and second contact terminal members are brought adjacent to each other cooperatively embracing said post; and C) fastening means for holding together said first and third ends and said fastening means including an elongated fastening member with a threaded shank receivable within said first and second through openings, and said fastening member further including a hook end and a distal end, said hook end cooperatively engaging said conducting end, and said fastening means further including nut means for cooperatively mating with said distal end and urging said first and second ends against each other.

2. The battery contact terminal assembly set forth in claim 1 further including:

D) an anti-corrosion pad member mounted between said first and third ends.

3. The battery contact terminal assembly set forth in claim 2 wherein said pad member is impregnated with an anti-sulfate compound.

4. The battery contact terminal assembly set forth in claim 3 wherein said nut means is a wing nut.

* * * * *